United States Patent [19]

Bokmiller

[11] Patent Number: 4,642,836

[45] Date of Patent: Feb. 17, 1987

[54] CLEANING WAND

[75] Inventor: David J. Bokmiller, San Antonio, Tex.

[73] Assignee: Sani-Fresh International, Inc., San Antonio, Tex.

[21] Appl. No.: 652,863

[22] Filed: Sep. 20, 1984

Related U.S. Application Data

[63] Continuation-in-part of Ser. No. 592,945, Mar. 23, 1984.

[51] Int. Cl.[4] ..... A47L 13/12

[52] U.S. Cl. ..... 15/118; 15/114; 15/145; 15/147 A; 15/229 R

[58] Field of Search ..... 15/114, 115, 118, 145, 15/147 A, 244 R, 228, 229 R

[56] References Cited

U.S. PATENT DOCUMENTS

| | | | |
|---|---|---|---|
| 234,124 | 11/1880 | Goetting | 15/244 R |
| 315,814 | 4/1885 | Morgan | 15/244 R |
| 1,341,803 | 6/1920 | Jansen . | |
| 1,468,431 | 9/1923 | Wodonos . | |
| 1,651,674 | 12/1927 | Collins . | |
| 1,677,194 | 7/1928 | Mendoza . | |
| 1,834,510 | 12/1931 | Yeater . | |
| 1,886,338 | 11/1932 | Hirth | 15/147 A |
| 1,894,420 | 1/1933 | Ranish . | |
| 2,047,199 | 7/1936 | Gewalt | 91/25 |
| 2,683,886 | 7/1954 | Neumann | 15/118 X |
| 2,770,828 | 11/1956 | Ellman . | |
| 2,832,089 | 4/1958 | Schwartz et al. | 15/145 X |
| 2,835,914 | 5/1958 | Littleton | 15/145 X |
| 2,995,768 | 8/1961 | Skuratowicz . | |
| 3,197,800 | 8/1965 | Karkut . | |
| 3,304,573 | 2/1967 | Stefely . | |
| 3,343,200 | 9/1967 | During . | |
| 3,353,202 | 11/1967 | Winstead et al. | 15/229 R |
| 3,663,981 | 5/1972 | DuCrest et al. | 15/228 X |
| 3,682,516 | 8/1972 | Savage | 15/145 X |
| 3,864,047 | 2/1975 | Sherrod | 132/84 D |
| 4,135,272 | 1/1979 | Stephenson | 15/147 R |
| 4,377,879 | 3/1983 | Christo | 15/229 A |
| 4,417,364 | 11/1983 | Hammond | 15/147 R |
| 4,457,038 | 7/1984 | Hammond | 15/145 |
| 4,534,669 | 8/1985 | Heck et al. | 401/134 |

FOREIGN PATENT DOCUMENTS

| | | | |
|---|---|---|---|
| 268151 | 2/1969 | Austria | 15/118 |
| 1128262 | 7/1982 | Canada | 15/147 A |
| 3308490 | 9/1984 | Fed. Rep. of Germany | 15/118 |
| 925441 | 9/1947 | France | 15/118 |
| 2361085 | 10/1978 | France . | |
| 747268 | 3/1956 | United Kingdom | 15/118 |

*Primary Examiner*—Chris K. Moore
*Attorney, Agent, or Firm*—Sisson & Smith

[57] ABSTRACT

A multifunction cleaning wand having a disposable head. The cleaning head is removably attachable to the wand handle. A first cleaning element in the shape of a swab is secured to a retainer by a flexible strap. The retainer is removably attached to the cleaning head. A second cleaning element is attached to the head on a side thereof opposite the swab. A method for assembling the cleaning wand is also disclosed.

23 Claims, 11 Drawing Figures

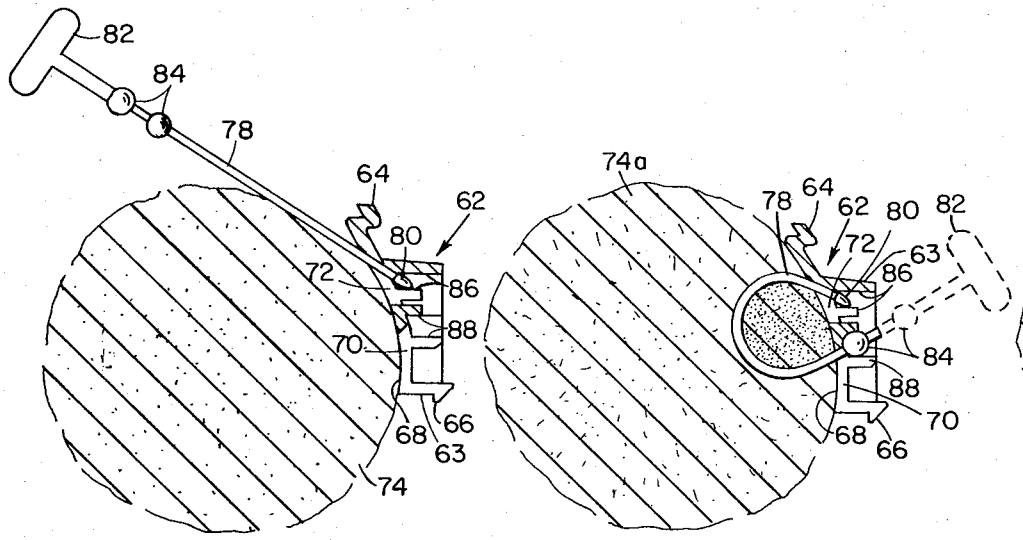
FIG. 2A
FIG. 2B
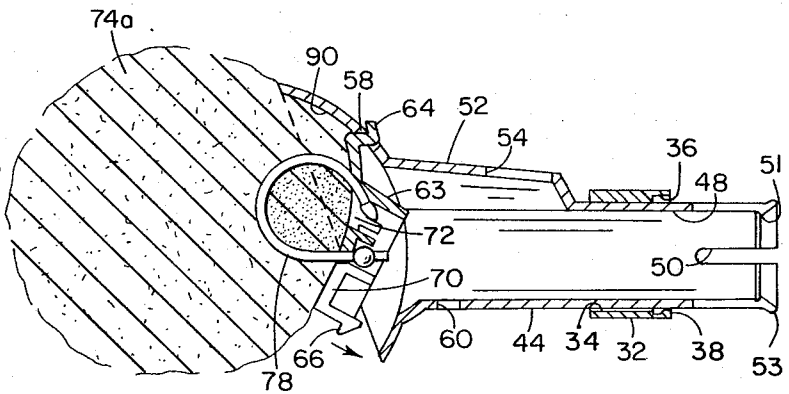
FIG. 2C
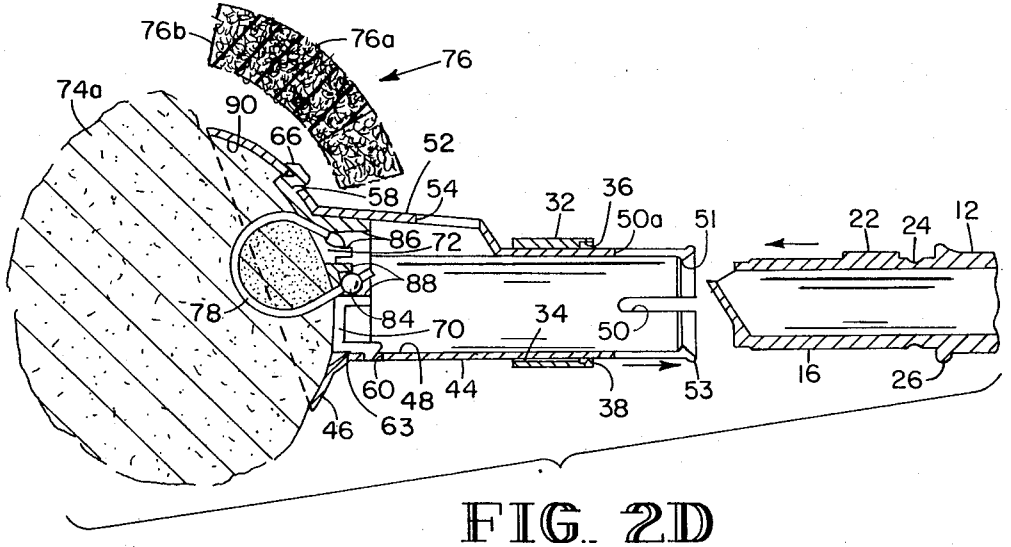
FIG. 2D
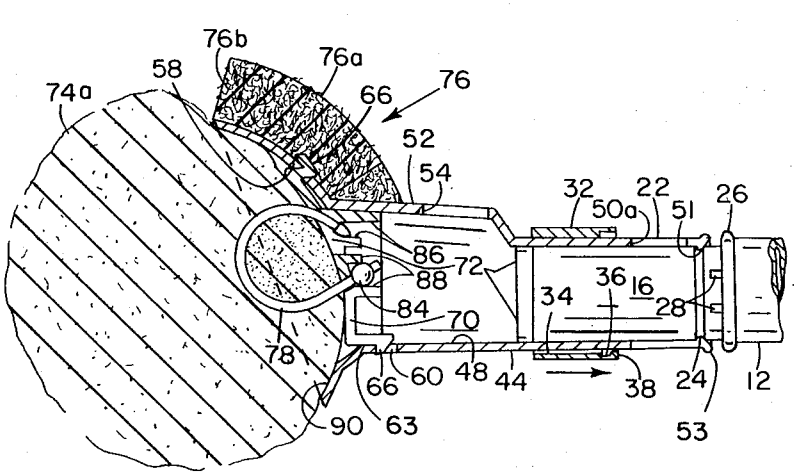
FIG. 2E

CLEANING WAND

The present application is a continuation-in-part of U.S. patent application Ser. No. 592,945 filed Mar. 23, 1984, entitled CLEANING SYSTEM.

BACKGROUND OF THE INVENTION

This invention relates to an improved cleaning wand including a head removably attachable to a handle, and method for assembling same, for cleaning lavatory facilities.

The cleaning of lavatory facilities, such as toilet bowls and urinals, often requires the utilization of a cleaning device or wand. A cleaning wand typically comprises a handle having a brush or cleaning head on one end thereof. Further, the brush or head is typically permanently attached to the handle, thereby requiring disposal of the entire device when the head or brush becomes worn or otherwise unusable. If the cleaning head is not securely attached to the handle it may tend to loosen and/or fall off during the cleaning process. Finally, the device typically accommodates only a single type of cleaning element.

Prior attempts to alleviate the problems associated with lavatory cleaning devices are shown in U.S. Pat. No. 4,417,364 issued to Hammond, U.S. Pat. No. 4,377,879 issued to Christo, and U.S. Pat. No. 4,135,272 issued to Stephenson. U.S. Pat. No. 4,377,879 discloses a cleaning head or connector which is connected to a handle by means of a retaining projection on the inner surface of the connector and a receiving groove in the handle. U.S. Pat. Nos. 4,417,364 and 4,135,272 disclose a cleaning connector or head in threaded engagement with the handle. Removal of the connector or head thus requires the cumbersome rotation of the handle and/or rotation of the connector or head. If the brush or yarn has any cleaning solution thereon and the connector is rotated, the acidic solution may easily spin off onto the user's face or clothing.

In addition to the above described limitation, none of the devices disclosed in the aforementioned patents permit the removal of the yarn or other cleaning elements from the head or connector without the removal of the strap which connects the cleaning elements directly to the head. Furthermore, all of the devices described in the referenced patents are limited to the utilization of a single cleaning element, namely, a plurality of threads or pieces of yarn.

SUMMARY OF THE INVENTION

Accordingly, the present invention provides a cleaning wand having a cleaning head removably attachable to a handle and a cleaning element retainer which is removably attachable to the head. Furthermore, the present invention provides for the attachment of a plurality of cleaning elements to the head. A method for readily assembling the cleaning tool is also disclosed.

The cleaning head includes a hollow sleeve adapted to receive the cleaning wand handle and a base adapted to receive the cleaning element retainer. The sleeve receives an end of the handle and is secured via detents that cooperate with a radial groove in the handle. The head is locked in position by a collar or ferrule that slides axially on the outer diameter of the sleeve and engages a raised radial rib on the end of the sleeve, thereby providing a detented lock by cooperating with an internal groove or depression on the inner diameter of the collar. Sliding the collar toward the base readily disengages the head from the handle.

A swab, fiber bundle, or other cleaning element is secured to a cleaning element retainer by means of a flexible strap. The retainer is adapted to permit securement of the strap thereto and is further provided with a plurality of barbs. The barbs cooperate with a pair of slots in the head to permit a detachable snap fit between the swab retainer and head. An alternate or second cleaning element is also attached to the head. The swab and/or head may be readily disposed after use.

The present invention thus overcomes the limitations inherent in prior devices by providing a cleaning head which can be securely attached to the handle and readily removed without rotation and without contacting the soiled cleaning element. Further, the present invention permits the removal of the cleaning element from the head and/or wand without the necessity of removing the strap and/or head. Finally, the present invention provides a multifunction cleaning head which encompasses a plurality of cleaning elements and/or cleaning surfaces.

BRIEF DESCRIPTION OF THE DRAWINGS

FIGS. 2A–2E is a sequential, cross sectional view illustrating assembly of a preferred embodiment of an improved cleaning wand.

DETAILED DESCRIPTION OF THE PREFERRED EMBODIMENT

Figure 1:
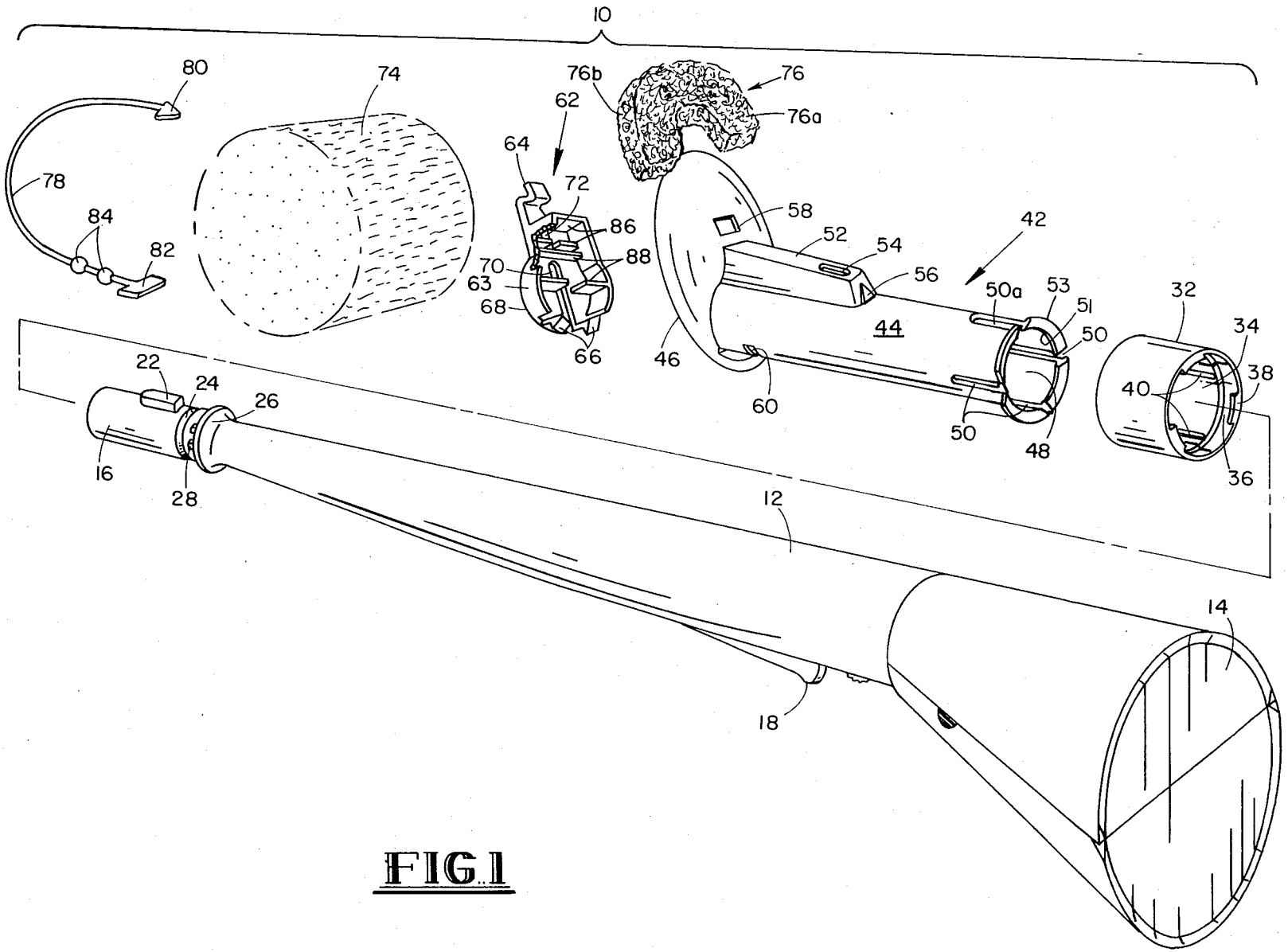
FIG. 1 is an exploded perspective view of a preferred embodiment of an improved cleaning wand.

Referring to FIG. 1, a preferred embodiment of an improved cleaning wand is identified by the number 10. The wand includes a handle 12 having a rearward end 14 and a forward end 16. In the embodiment illustrated, a cleaning fluid cartridge and pump mechanism may be located in the rearward end 14 of handle 12 with the cleaning fluid urged outward through the forward end 16 by means of a trigger 18. It is to be understood, however, that any type of handle may be utilized having a forward end 16, as hereinafter described.

Referring again to FIG. 1, the forward end 16 of handle 12 is provided with a raised, integral boss or key 22 and an annular, radial groove or depression 24. Forward end 16 is also provided with an annular, raised lip 26 and a plurality of bosses 28 intermediate groove 24 and lip 26. Cleaning wand 10 is also provided with a collar or ferrule 32 having a hollow passage 34 therethrough. The inner diameter of collar 32 is provided with an annular groove or depression 36 on the rearward end thereof and collar 32 has a plurality of shoulders 38 located at spaced intervals about the rearward end thereof. Finally, the internal diameter of collar 32 is provided with a plurality of raised ribs 40 which extend the length of passage 34.

Referring again to FIG. 1, the improved cleaning wand 10 is further provided with a cleaning head or holder 42 having a sleeve 44 on the rearward end thereof and a spherical, concave base 46 integral therewith on the forward end thereof. Sleeve 44 has a hollow passage 48 therethrough and a plurality of grooves or slots 50 on the rearward end thereof. As explained in greater detail hereinbelow, individual groove 50*a* is larger than the remainder of the grooves 50 and is adapted to receive key 22 therein. On the rearward end of sleeve 44, the internal diameter is provided with a plurality of lips or detents 51 intermediate grooves 50 and the external diameter is provided with a plurality of shoulders or raised radial ribs 53 intermediate grooves 50. Head 42 is further provided with a raised, radial boss 52 which extends axially along the sleeve 44 from the base 46 to approximately midpoint on the sleeve 44. Boss 52 is further provided with a discharge orifice 54 for discharging cleaning fluid from handle 12, as previously described, or draining fluid from head 42, and an alignment indicator 56. Boss 52 provides recessed protection of the cleaning fluid spray tip (not shown) to prevent clogging and/or damage during use. Finally, head 42 is provided with a first barb groove 58 in base 46 and a second barb groove 60 in the forward end of sleeve 44.

Still referring to FIG. 1, the improved cleaning wand 10 is provided with a cleaning element connector or retainer 62 having a singular integral barb 64 on one end thereof and a pair of integral barbs 66 on the opposite end thereof. Retainer 62 is preferably constructed of injection molded plastic. Retainer 62 has a concave, uppermost surface 68 having a slot 70 and a slot 72 therethrough. Retainer 62 has a base 63 and is provided with a plurality of retainer ribs 86 and 88 on the underside thereof within base 63.

Improved cleaning wand 10 is also provided with a first cleaning element 74 and a second cleaning element 76. Improved cleaning wand 10 is further provided with a flexible strap 78 for attaching cleaning element 74 to retainer 62, as hereinafter described. Strap 78 is provided with a T-shaped end 80, a handle grip 82, and a pair of spherical projections 84 integral with strap 78 and located near hand grip 82.

Figure 5A:
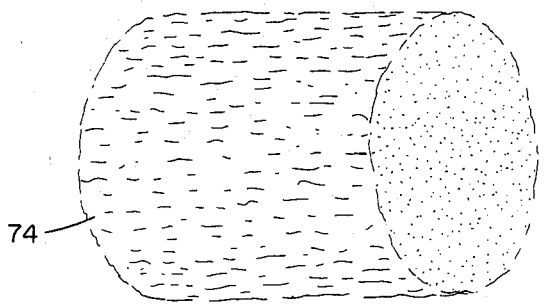
FIGS. 5A–5C is a sequential view illustrating assembly of a cleaning element and connection thereto to a cleaning element retainer.
Figure 5B:
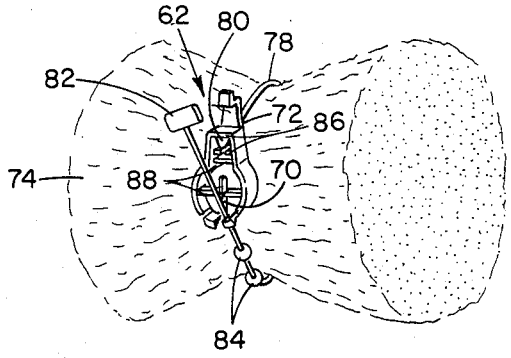
Figure 5C:
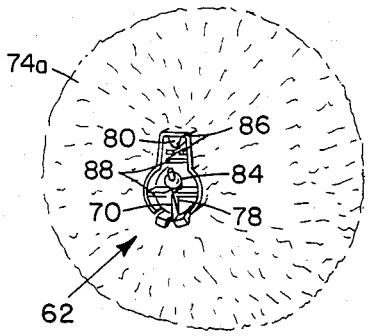

Referring to FIGS. 2A–2E and 5A–5C, the assemblage of the improved cleaning wand 10 is shown in greater detail. Integral T-shaped end 80 of strap 78 is inserted into slot 72 and rotated 90° to facilitate an interference fit between retainer ribs 86 which are integrally molded within retainer 62, as illustrated in FIG. 2A. The first cleaning element 74, illustrated in FIG. 5A, is thereafter placed atop concave surface 68 of retainer 62, as further illustrated in FIG. 2A. Strap 78 is thereafter rotated to circumscribe cleaning element 74 by means of integral handle 82, as illustrated in FIG. 2B and FIG. 5B. The flexible strap 78 is drawn through groove 70 until first or second spherical projection 84 forms an interference fit between retainer ribs 88 which are integrally molded within retainer 62, as illustrated in FIG. 2B and FIG. 5C. The remainder of flexible strap 78 is thereafter cut or otherwise severed, as illustrated in FIG. 5C and by the dashed lines in FIG. 2B, to facilitate clearance within passage 48. It is to be understood that the location of spherical projection 84 on strap 78 is critical to the tension applied to cleaning element bundle 74. Further, strap 78 in combination with retainer 62 located in approximately the center of bundle 74 transform fiber bundle 74 into a swab 74*a*.

Referring to FIG. 2C, retainer 62 having cleaning element 74*a* fixed thereto is removably attached to the spherical, concave interior 90 of base 46 by inserting barb 64 into slot 58. Retainer 62 with swab 74*a* connected thereto is thereafter rotated upward and into the spherical interior 90, as illustrated by the arrow in FIG. 2C, until barbs 66 snap and lock into slot 60, as illustrated in FIG. 2D. In this position, base 63 of retainer 62 forms a snug fit within the forward end of hollow passage 48. Referring to FIG. 2D and FIG. 2E, the second cleaning element 76 is appropriately secured to the spherical, exterior surface of base 46 by a hot melt adhesive, thereby covering barb 66.

Head assembly 42 is connected to handle 12 by inserting forward end 16 into hollow passage 48 of sleeve 44, as illustrated by the arrows in FIG. 2D. It is to be understood that grooves 50 and 50*a* provide a means of flexing the rearward end of sleeve 44 to overcome the interference established by lips 51. When forward end 16 has been properly inserted into passage 48, key 22 will be received within orientation groove 50*a*, lips 51 will be received within groove 24 in a snap fit, and shoulders 53 will abut against bosses 28, as illustrated in FIG. 2E. The proper insertion of forward end 16 into sleeve 44 is facilitated by aligning key 22 up with groove 50*a* and alignment indicator 56 on boss 52. Indicator 56 also identifies the direction of discharge of cleaning fluid from orifice 54.

Figures 3, 4:
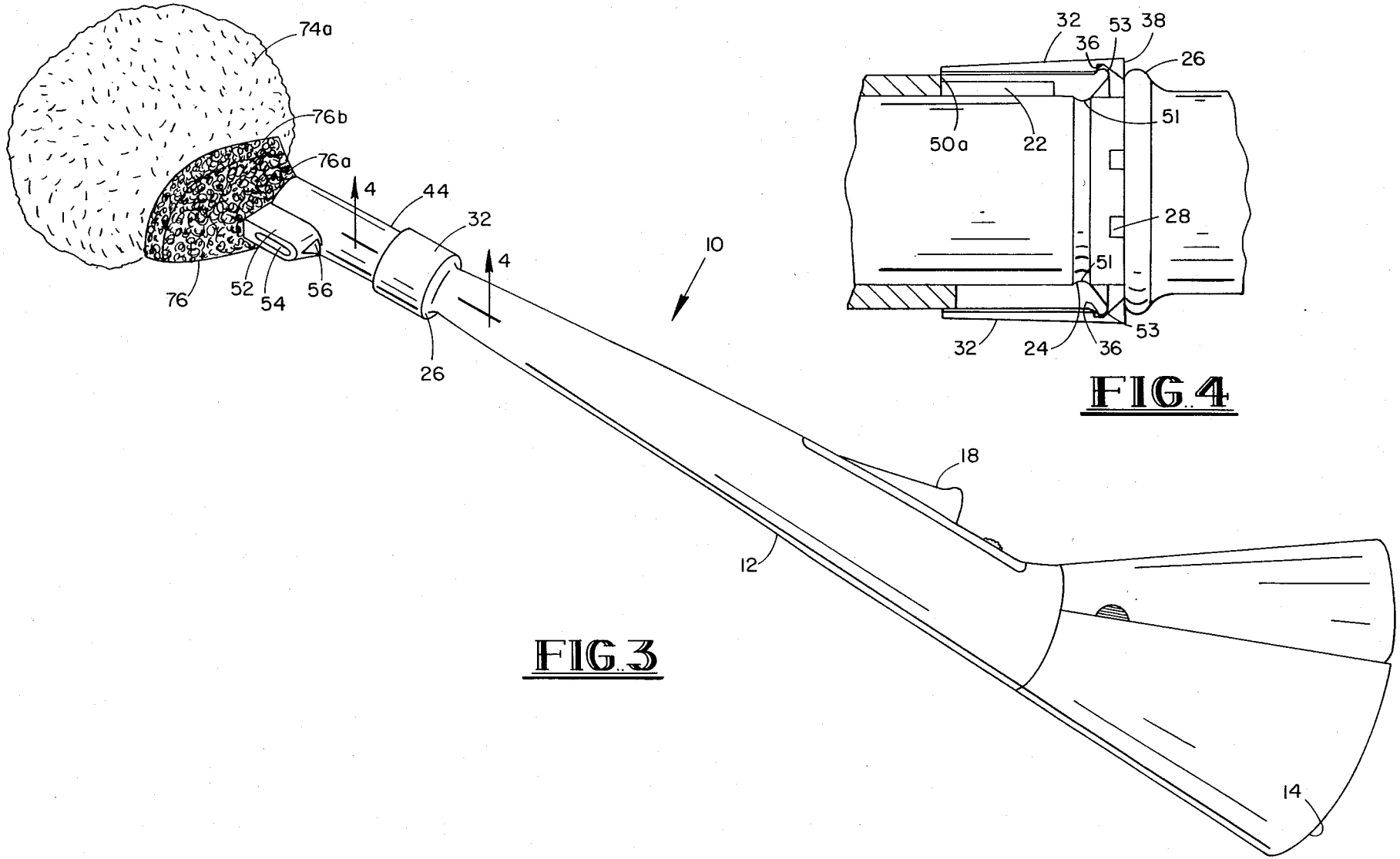
FIG. 3 is an assembled perspective view of a preferred embodiment of an improved cleaning wand.
FIG. 4 is a cross sectional view taken along section lines 4—4 of FIG. 3 illustrating the connection of a preferred embodiment of a cleaning head to a cleaning wand handle.

As further illustrated in FIG. 2E, collar 32 is adapted to slide axially along the length of sleeve 44 with sleeve 44 being received within passage 34. Such axial movement back and forth along the exterior or outer diameter of sleeve 44 is facilitated by ribs 40. The assemblage of the improved cleaning wand 10 is thus completed, as illustrated in FIG. 3, by sliding collar 32 along the length of sleeve 44, as illustrated by the arrow in FIG. 2E, thereby locking head 42 onto handle 12. As illustrated in FIG. 4, collar shoulder 38 abuts against annular lip 26 and collar groove 36 receives sleeve shoulder 53, thereby providing detachable, locked engagement between head 42 and handle 12. Head 42 may be readily disengaged from handle 12 in the reverse of the engagement process by grasping handle 12 and sliding collar 32 toward base 46, groove 24 overcoming detents 51 and collar 32 abutting against boss 52, thereby resulting in detachment of head 42 from handle 12 without contacting cleaning elements 74 or 76. In the preferred embodiment, cleaning element 74 comprises approximately seven hundred (700) strands of random polypropylene fiber cut in lengths of approximately three and one-half inches ($3\frac{1}{2}''$) and combined into one bundle, as illustrated in FIG. 5A. As previously described, the bundled fibers 74 are converted into a swab 74*a* having a mop-like shape by strap 78 and retainer 62, thereby providing a real means to clean inside and outside surfaces of toilets and urinals. The concave, interior surface 90 of base 46 assists in the formation and retention of the desired swab shape and provides reinforcement for optimizing the cleaning function of the swab 74*a*. The combined bundling and forming of the fibers 74 into a puff like swab 74*a* creates ideal water characteristics. For example, absorbency and saturation is inherent in the fiber and release by shaking is also excellent, again due to the inherent nature of the polypropylene fiber. However, the tightly bundled core created by the strap 78 and retainer 62 working in cooperation with the concave, spherical interior 90 of the head 42 absorbs and retains transient fluid and retards dripping.

Cleaning element 76 is preferably a non-woven fiber pad having cleaning surfaces 76*a* and 76*b*, as illustrated in FIG. 1 and FIG. 3. Each of the respective cleaning surfaces of pad 76 provides an agressive brushlike means of cleaning the flush hole and under the flush ring of a toilet bowl or urinal. It is to be understood that cleaning element 76 will be provided with a proper size and shape to accommodate the design of the toilet bowl or urinal to be cleaned.

The present invention thus provides a disposable, multifunction cleaning device including a plurality of cleaning elements and/or cleaning surfaces. The swab 74*a* and retainer 62 are removably attachable to head 42 and head 42 is removably attachable to handle 12. Further, the head 42 may be readily aligned on and removed from the handle 12 without contacting the potentially soiled cleaning surfaces. Finally, swab 74*a* has ideal water retention characteristics for optimum cleaning of inner and outer surfaces and excellent non-dripping characteristics when the cleaning process has been concluded.

While the improved cleaning wand and method for assembling same have been described in connection with the preferred embodiment, it is not intended to limit the invention to the particular form set forth, but on the contrary, it is intended to cover such alternatives, modifications, and equivalents as may be included within the spirit and scope of the invention as defined by the appended claims.

I claim:

1. A cleaning wand, comprising:

a head having a longitudinal axis;

a handle having a longitudinal axis;

means for removably attaching said head to said handle comprising:

a lip on an inner surface of said head, said lip being substantially transverse to said longitudinal axis of said head, said head having a passage therein within which to receive said handle, said handle having a handle groove in an outer surface thereof substantially transverse to said longitudinal axis of said handle for mating with said lip, said lip and handle groove adapted to become releasably engaged upon alignment of said lip with said groove at the end of relative axial movement of said handle through said head passage; and a collar in surrounding relation to a portion of said head, said collar slidable along an outer surface of said head between a first position and a second position along said longitudinal axis of said head, said collar having a collar groove in an inner surface thereof substantially transverse to said longitudinal axis of said head for mating with a head shoulder on said head, said shoulder being substantially transverse to said longitudinal axis of said head, said shoulder and collar groove adapted to become releasably engaged when said collar is in said second position at the end of relative axial movement of said collar, said collar overlaying said head shoulder, said lip, and said handle groove when said lip and handle groove are releasably engaged and said collar is in said second position, to releasably lock said head, collar, and handle together, thereby permitting removable attachment of said head to said handle without requiring rotation of said head, said collar, or said handle;

a cleaning element; and means for removably attaching said cleaning element to said head.

2. A cleaning head having a longitudinal axis, comprising:

a sleeve having a base portion;

means for removably attaching said sleeve to a handle having a longitudinal axis comprising:

a lip on an inner surface of said sleeve, said lip adapted to mate with a groove in an outer surface of said handle substantially tranverse to said longitudinal axis of said handle, said sleeve having a passage therein within which to receive said handle, said lip adapted to become releasably engaged with said handle groove upon alignment of said lip with said groove at the end of relative axial movement of said handle through said head passage; and a collar in surrounding relation to a portion of said sleeve, said collar slidable along an outer surface of said sleeve between a first position and a second position along said longitudinal axis of said head, said collar having a collar groove in an inner surface thereof substantially transverse to said longitudinal axis of said head for mating with a shoulder on a rearward end of said sleeve, said shoulder being substantially transverse to said longitudinal axis of said head, said shoulder and collar groove adapted to become releasably engaged when said collar is in said second position at the end of relative axial movement of said collar, said collar overlaying said head shoulder, said lip, and said handle groove when said lip and handle groove are releasably engaged and said collar is in said second position, to releasably lock said head, collar, and handle together, thereby permitting removable attachment of said head to said handle without requiring rotation of said head, said collar, or said handle;

a cleaning element; and means for removably attaching said cleaning element to said sleeve.

3. Apparatus for removably attaching a cleaning head having a longitudinal axis to a handle having a longitudinal axis, comprising:

a lip on an inner surface of a rearward end of said head, said lip adapted to mate with a groove in an outer surface of said handle substantially transverse to said longitudinal axis of said handle, said head having a passage therein within which to receive said handle, said lip extending into said passage substantially transverse to said longitudinal axis of said head, said lip adapted to become releasably engaged with said handle groove upon alignment of said lip with said groove at the end of relative axial movement of said handle through said head passage; and a collar in surrounding relation to a portion of said head, said collar slidable along an outer surface of said head between a first position and a second position along said longitudinal axis of said head, said collar having a groove in an inner surface thereof substantially transverse to said longitudinal axis of said head adapted for mating with a head shoulder on said rearward end of said head substantially transverse to said longitudinal axis of said head, said shoulder and collar groove adapted to become releasably engaged when said collar is in said second position at the end of relative axial movement of said collar, said collar overlaying said head shoulder, said lip, and said handle groove when said lip and handle groove are releasably engaged and said collar is in said second position, to releasably lock said head, collar, and handle together, said apparatus thereby permitting removable attachment of said head to said handle without requiring rotation of said head, said collar, or said handle.

4. A cleaning wand, comprising:

a head:

a handle;

means for removably attaching said head to said handle;

a first cleaning element;

means for removably attaching said first cleaning element to said head comprising a flexible strap for attaching said first cleaning element to a retainer, said retainer having first barb means for engaging a first slot in said head and second barb means for engaging a second slot in said head; and a second cleaning element attached to said head.

5. A cleaning head, comprising:

a base;

a sleeve connected to said base;

means for removably attaching said sleeve to a handle;

a first cleaning element;

means for removably attaching said first cleaning element to a first side of said base comprising a flexible strap for attaching said first cleaning element to a retainer, said retainer having first barb means for engaging a slot in said base and second barb means for engaging a slot in said sleeve; and a second cleaning element attached to a second side of said base.

6. A cleaning wand, as recited in claim 4, wherein said first cleaning element is a bundle of polypropylene fibers in the shape of a swab and said second cleaning element is a non-woven fiber pad.

7. A method of wand, comprising the steps of:

(a) attaching a cleaning element to a cleaning element retainer;

(b) attaching said cleaning element retainer to a cleaning head having a longitudinal axis; and (c) attaching a cleaning head having a cleaning element and a longitudinal axis to a handle having a longitudinal axis comprising the steps of:

(i) inserting an end of said handle into a sleeve of said cleaning head, said handle end having a groove therein substantially transverse to said longitudinal axis of said handle for mating with a lip on an inner surface of said sleeve, said lip being substantially transverse to said longitudinal axis of said head, said lip and handle groove becoming releasably engaged upon alignment of said lip with said groove at the end of relative axial movement of said handle through said sleeve; and (ii) sliding a collar over said sleeve and said handle end along said longitudinal axis of said head, said collar having an internal groove substantially transverse to said longitudinal axis of said head for mating with a rib on an outer surface of said sleeve, said rib being substantially transverse to said longitudinal axis of said head, said rib and collar groove becoming releasably engaged at the end of relative axial movement of said collar, said collar overlaying said rib, said lip, and said handle groove when said lip and handle groove are releasably engaged and said rib and collar groove are releasably engaged, to releasably lock said head, collar, and handle together, thereby permitting removable attachment of said head to said handle without requiring rotation of said head, said collar, or said handle.

8. A method of assembling a cleaning wand, comprising the steps of:

(a) attaching a first cleaning element to a cleaning element retainer comprising the steps of:

(i) placing a first T-shaped end of flexible strap into a first groove in said retainer so as to form an interference fit within said first groove between first ribs within said retainer;

(ii) placing said first cleaning element atop said retainer;

(iii) bending said strap about said first cleaning element; and (iv) inserting a second end of said strap into a second groove in said retainer, said second strap end having a projection thereon to form an interference fit within said second groove between second ribs within said retainer;

(b) attaching said cleaning element retainer to a first side of a cleaning head;

(c) attaching said cleaning head to a handle; and (d) attaching a second cleaning element to a second side of said cleaning head.

9. A method of assembling a cleaning wand, comprising the steps of:

(a) attaching a cleaning element to a cleaning element retainer;

(b) attaching said cleaning element retainer to a cleaning head having a longitudinal axis comprising the steps of:

(i) inserting a first barb means on said retainer into a first slot in a base of said cleaning head; and (ii) inserting a second barb means on said retainer into a second slot in a sleeve of said cleaning head;

(c) attaching said cleaning head to a handle having a longitudinal axis comprising the steps of:

(i) inserting an end of said handle into a sleeve of said cleaning head, said handle end having a groove therein substantially transverse to said longitudinal axis of said handle for mating with a lip on an inner surface of said sleeve, said lip being substantially transverse to said longitudinal axis of said head, said lip and handle groove becoming releasably engaged upon alignment of said lip with said groove at the end of relative axial movement of said handle through said sleeve and (ii) sliding a collar over said sleeve and said handle end along said longitudinal axis of said head, said collar having an internal groove substantially transverse to said longitudinal axis of said head for mating with a rib on an outer surface of said sleeve, said rib being substantially transverse to said longitudinal axis of said head, said rib and collar groove becoming releasably engaged at the end of relative axial movement of said collar, said collar overlaying said rib, said lip, and said handle groove when said lip and handle groove are releasably engaged and said rib and collar groove are releasably engaged, to releasably lock said head, collar, and handle together, thereby permitting removable attachment of said head to said handle without requiring rotation of said head, said collar, or said handle.

10. A cleaning head, as recited in claim 2, wherein said sleeve has a plurality of longitudinal grooves therein extending from said rearward end of said sleeve.

11. A method of assembling a cleaning wand, as recited in claim 7, comprising the additional step of attaching a second cleaning element to said cleaning head.

12. A cleaning wand, as recited in claim 1, wherein said collar further comprises a collar shoulder substantially transverse to said longitudinal axis of said head for abutting a lip on said handle, said handle lip being substantially transverse to said longitudinal axis of said handle.

13. A cleaning wand, comprising:

a head;

a handle;

means for removably attaching said head to said handle;

a cleaning element; and means for removably attaching said cleaning element to said head comprising a flexible strap for attaching said cleaning element to a retainer, said retainer having first barb means for engaging a first slot in said head and second barb means for engaging a second slot in said head.

14. A cleaning wand, comprising:

a head;

a handle;

a cleaning element;

means for removably attaching said cleaning element to said head comprising a flexible strap for attaching said cleaning element to a retainer, said retainer having first barb means for engaging a first slot in said head and second barb means for engaging a second slot in said head.

15. A cleaning head, comprising:

a sleeve having a base portion;

means for removably attaching said sleeve to a handle;

a cleaning element;

means for removably attaching said cleaning element to said sleeve comprising a flexible strap for attaching said cleaning element to a retainer, said retainer having first barb means for engaging a first slot in said sleeve and second barb means for engaging a second slot in said sleeve.

16. A cleaning head, comprising:

a sleeve having a base portion;

a cleaning element;

means for removably attaching said cleaning element to said sleeve comprising a flexible strap for attaching said cleaning element to a retainer, said retainer having first barb means for engaging a first slot in said sleeve and second barb means for engaging a second slot in said sleeve.

17. A cleaning wand, comprising:

a head having a longitudinal axis;

a handle having a longitudinal axis;

means for removably attaching said head to said handle comprising a lip on an inner surface of said head, said lip being substantially transverse to said longitudinal axis of said head, said head having a passage therein within which to receive said handle, said handle having a handle groove in an outer surface thereof substantially transverse to said longitudinal axis of said handle for mating with said lip, said lip and handle groove adapted to become releasably engaged upon alignment of said lip with said groove at the end of relative axial movement of said handle through said head passage, and a collar slidable along an outer surface of said head along said longitudinal axis of said head, said collar having a collar groove in an inner surface thereof substantially transverse to said longitudinal axis of said head for mating with a shoulder on said head, said head shoulder being substantially transverse to said longitudinal axis of said head, said shoulder and collar groove adapted to become releasably engaged at the end of relative axial movement of said collar, said collar overlaying said head shoulder, said lip, and said handle groove when said lip and handle groove are releasably engaged and said shoulder and collar groove are releasably engaged, to releasably lock said head, collar, and handle together, thereby permitting removable attachment of said head to said handle without requiring rotation of said head, said collar, or said handle;

a cleaning element; and means for removably attaching said cleaning element to said head comprising a flexible strap for attaching said cleaning element to a retainer, said retainer including means for engaging a first slot in said head and a second slot in said head.

18. A cleaning head having a longitudinal axis, comprising:

a sleeve having a base portion;

means for removably attaching said sleeve to a handle having a longitudinal axis, comprising a lip on an inner surface of said sleeve, said lip adapted to mate with a handle groove in an outer surface of said handle substantially transverse to said longitudinal axis of said handle, said sleeve having a passage therein within which to receive said handle, said lip adapted to become releasably engaged with said handle groove upon alignment of said lip with said groove at the end of relative axial movement of said handle through said head passage, and a collar slidable along an outer surface of said sleeve along said longitudinal axis of said head, said collar having a collar groove in an inner surface thereof substantially transverse to said longitudinal axis of said head for mating with a shoulder on a rearward end of said sleeve, said shoulder being substantially transverse to said longitudinal axis of said head, said shoulder and collar groove adapted to become releasably engaged at the end of relative axial movement of said collar, said collar overlaying said head shoulder, said lip, and said handle groove when said lip and handle groove are releasably engaged and said shoulder and collar groove are releasably engaged, to releasably lock said head, collar, and handle together, thereby permitting removable attachment of said head to said handle without requiring rotation of said head, said collar, or said handle;

a cleaning element; and means for removably attaching said cleaning element to said sleeve comprising a flexible strap for attaching said cleaning element to a retainer, said retainer including means for engaging a first slot in said sleeve and a second slot in said sleeve.

19. A method of assembling a cleaning wand, comprising the steps of:

(a) attaching a cleaning element to a cleaning element retainer;

(b) attaching said cleaning element retainer to a cleaning head having a longitudinal axis comprising the steps of:
(i) inserting first barb means on said retainer into a first slot in said cleaning head; and
(ii) inserting second barb means on said retainer into a second slot in said cleaning head; and
(c) attaching said cleaning head to a handle having a longitudinal axis comprising the steps of:
(i) inserting an end of said handle into a sleeve of said cleaning head, said handle end having a groove therein substantially transverse to said longitudinal axis of said handle for mating with a lip on an inner surface of said sleeve, said lip being substantially transverse to said longitudinal axis of said head, said lip and handle groove becoming releasably engaged upon alignment of said lip with said groove at the end of relative axial movement of said handle through said sleeve; and
(ii) sliding a collar over said sleeve and said handle end along said longitudinal axis of said head, said collar having an internal groove substantially transverse to said longitudinal axis of said head for mating with a rib on an outer surface of said sleeve substantially transverse to said longitudinal axis of said head, said rib and collar groove becoming releasably engaged at the end of relative axial movement of said collar, said collar overlaying said rib, said lip, and said handle groove when said lip and handle groove are releasably engaged and said rib and collar groove are releasably engaged to releasably lock said head, collar, and handle together, thereby permitting removable attachment of said head to said handle without requiring rotation of said head, said collar, or said handle.

20. A cleaning head, comprising:
a base;
a sleeve connected to said base;
a cleaning element; and
a flexible strap for attaching said cleaning element to a retainer, said retainer including means for engaging a first slot in said head and a second slot in said head.

21. A cleaning wand having a cleaning element connected thereto, comprising:
a first member having a longitudinal axis;
a second member having a longitudinal axis; and
means for removably attaching said first member to said second member comprising:
a lip on an inner surface of said first member of said wand, said lip being substantially transverse to said longitudinal axis of said first member of said wand, said first member having a passage therein in which to receive said second member, said second member of said wand having a complimentary groove in an outer surface thereof substantially transverse to said longitudinal axis of said second member of said wand for mating with said lip, said lip and groove adapted to become releasably engaged upon alignment of said lip with said groove at the end of relative axial movement of said second member through said first member passage; and
a collar in surrounding relation to a portion of said first member of said wand, said collar slidable along an outer surface of said first member of said wand between a first position and a second position along said longitudinal axis of said first member of said wand, said collar having a groove in an inner surface thereof substantially transverse to said longitudinal axis of said first member of said wand for mating with a shoulder on said first member of said wand, said shoulder being substantially transverse to said longitudinal axis of said first member of said wand, said shoulder and collar groove adapted to become releasably engaged when said collar is in said second position at the end of relative axial movement of said collar, said collar overlaying said shoulder, said lip, and said groove when said lip and groove are releasably engaged and said collar is in said second position to releasably lock said first member, collar, and second member together, thereby permitting removable attachment of said first member of said wand to said second member of said wand without requiring rotation of said first member of said wand, said collar, or said second member of said wand.

22. A cleaning wand, comprising:
a head having a longitudinal axis;
a handle having a longitudinal axis;
means for removably attaching said head to said handle comprising:
a lip on an inner surface of said head, said lip being substantially transverse to said longitudinal axis of said head, said head having a passage therein within which to receive said handle, said handle having a handle groove in an outer surface thereof substantially transverse to said longitudinal axis of said handle for mating with said lip, said lip and handle groove adapted to become releasably engaged upon alignment of said lip with said groove at the end of relative axial movement of said handle through said head passage; and
a collar in surrounding relation to a portion of said head, said collar slidable along an outer surface of said head between a first position and a second position along said longitudinal axis of said head, said collar having a collar groove in an inner surface thereof substantially transverse to said longitudinal axis of said head for mating with a shoulder on said head, said head shoulder being substantially transverse to said longitudinal axis of said head, said shoulder and collar groove adapted to become releasably engaged when said collar is in said second position at the end of relative axial movement of said collar, said collar overlaying said head shoulder, said lip, and said handle groove when said lip and handle groove are releasably engaged and said collar is in said second position, to releasably lock said head, collar, and handle together, thereby permitting removable attachment of said head to said handle without requiring rotation of said head, said collar, or said handle; and
a cleaning element attached to said head.

23. A cleaning head having a longitudinal axis, comprising:
a sleeve having a base portion;
means for removably attaching said sleeve to a handle having a longitudinal axis comprising:
a lip on an inner surface of said sleeve, said lip adapted to mate with a groove in an outer surface of said handle substantially transverse to said longitudinal axis of said handle, said sleeve having a passage therein within which to receive said handle, said lip adapted to become releasably engaged with said handle groove upon alignment of said lip with said groove at the end of relative axial movement of said handle through said head passage; and a collar in surrounding relation to a portion of said sleeve, said collar slidable along an outer surface of said sleeve between a first position and a second position along said longitudinal axis of said head, said collar having a collar groove in an inner surface thereof substantially transverse to said longitudinal axis of said head for mating with a shoulder on a rearward end of said sleeve, said head shoulder being substantially transverse to said longitudinal axis of said head, said shoulder and collar groove adapted to become releasably engaged when said collar is in said second position at the end of relative axial movement of said collar, said collar overlaying said head shoulder, said lip, and said handle groove when said lip and handle groove are releasably engaged and said collar is in said second position, to releasably lock said head, collar, and handle together, thereby permitting removable attachment of said head to said handle without requiring rotation of said head, said collar, or said handle; and a cleaning element attached to said sleeve.

* * * * *